US005901822A

United States Patent [19]

Tu

[11] Patent Number: 5,901,822

[45] Date of Patent: May 11, 1999

[54] RETRACTABLE TRAVEL BAG PULLING HANDLE

[76] Inventor: A-Shih Tu, No. 61, 32rd Rd., Industrial Area of Taichung City, Taiwan

[21] Appl. No.: 08/964,109

[22] Filed: Nov. 5, 1997

[51] Int. Cl.[6] ..... A45C 5/14; A45C 13/22; A45C 13/26

[52] U.S. Cl. ..... 190/115; 190/39; 16/115

[58] Field of Search ..... 190/18 A, 39, 190/115; 16/115; 280/655.1

[56] References Cited

U.S. PATENT DOCUMENTS

| | | | |
|---|---|---|---|
| 3,513,952 | 5/1970 | Warner, Jr. | 190/18 A X |
| 4,358,005 | 11/1982 | Fontana | 190/115 X |
| 5,323,887 | 6/1994 | Scicluna et al. | 190/115 X |
| 5,464,081 | 11/1995 | Zwanzig | 190/115 |
| 5,491,872 | 2/1996 | Tserng | 190/115 X |
| 5,547,053 | 8/1996 | Liang | 190/115 |
| 5,630,521 | 5/1997 | Waddell et al. | 190/115 X |
| 5,689,854 | 11/1997 | Wang | 190/115 X |
| 5,690,196 | 11/1997 | Wang | 190/115 |
| 5,706,921 | 1/1998 | Wang | 190/115 |
| 5,713,441 | 2/1998 | Chen | 190/115 |

FOREIGN PATENT DOCUMENTS

| | | | |
|---|---|---|---|
| 3807435 | 9/1989 | Germany | 190/115 |
| 1014526 | 12/1965 | United Kingdom | 190/115 |

*Primary Examiner*—Sue A. Weaver
*Attorney, Agent, or Firm*—Rosenberg, Klein & Bilker

[57] ABSTRACT

A travel bag pulling handle is provided having two angular position control devices respectively mounted on bottom ends of two inner tubes. The inner tubes can be set in a vertical position and an oblique position when the inner tubes have been retracted from respective sleeves inside the travel bag.

1 Claim, 5 Drawing Sheets

RETRACTABLE TRAVEL BAG PULLING HANDLE

BACKGROUND OF THE INVENTION

FIG. 1 shows a wheeled travel bag equipped with a pulling handle. The pulling handle comprises a fixed mounting rod 2 fixedly mounted on the travel bag, a ball knob 6 raised from the top end of the fixed mounting rod 2, and a drag rod 1 having a ball socket 5 at one end coupled to the ball knob 6 (see FIG. 1A). The ball knob 6 and the ball socket 5 form a universal joint by which the drag rod 1 can be turned in different directions relative to the fixed mounting rod 2 (see FIG. 1B). This structure of carrying handle is still not satisfactory in function. Because the drag rod 1 is coupled to the fixed mounting rod 2 by a universal joint, the drag rod 1 cannot be firmly retained at the desired angle. When pushing the travel bag on the ground, applied force cannot be positively transmitted through the drag rod 1 to the travel bag through the fixed mounting rod 2, and the travel bag may be forced to move out of course, or to fall to the ground.

SUMMARY OF THE INVENTION

The present invention has been accomplished to provide a travel bag pulling handle which eliminates the aforesaid problems. According to the present invention, the pulling handle is a retractable handle including two joined inner tubes moved in and out of two sleeves, wherein two angular position control devices are respectively mounted on the bottom ends of the two inner tubes, for permitting the inner tubes to be set between a vertical position and an oblique position when the inner tubes have been moved out of the sleeves.

DETAILED DESCRIPTION OF THE PREFERRED EMBODIMENT

Figure 1B:
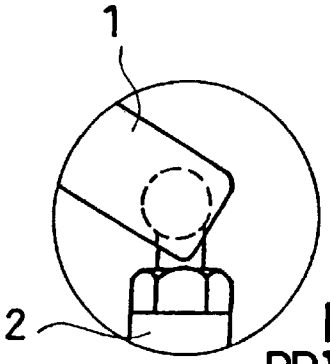
FIG.1B PRIOR ART
FIG. 1B is a sectional view in an enlarged scale of a part of the pulling handle shown in FIG. 1, showing the drag rod turned relative to the fixed mounting rod.
Figure 1A:
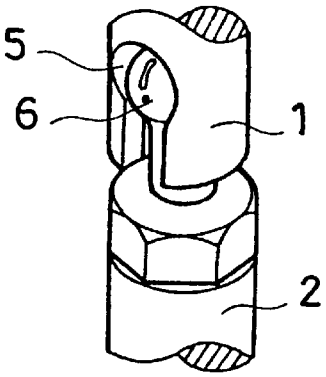
FIG.1A PRIOR ART
FIG. 1A is a perspective view in an enlarged scale of a part of the pulling handle shown in FIG. 1.
Figure 1:
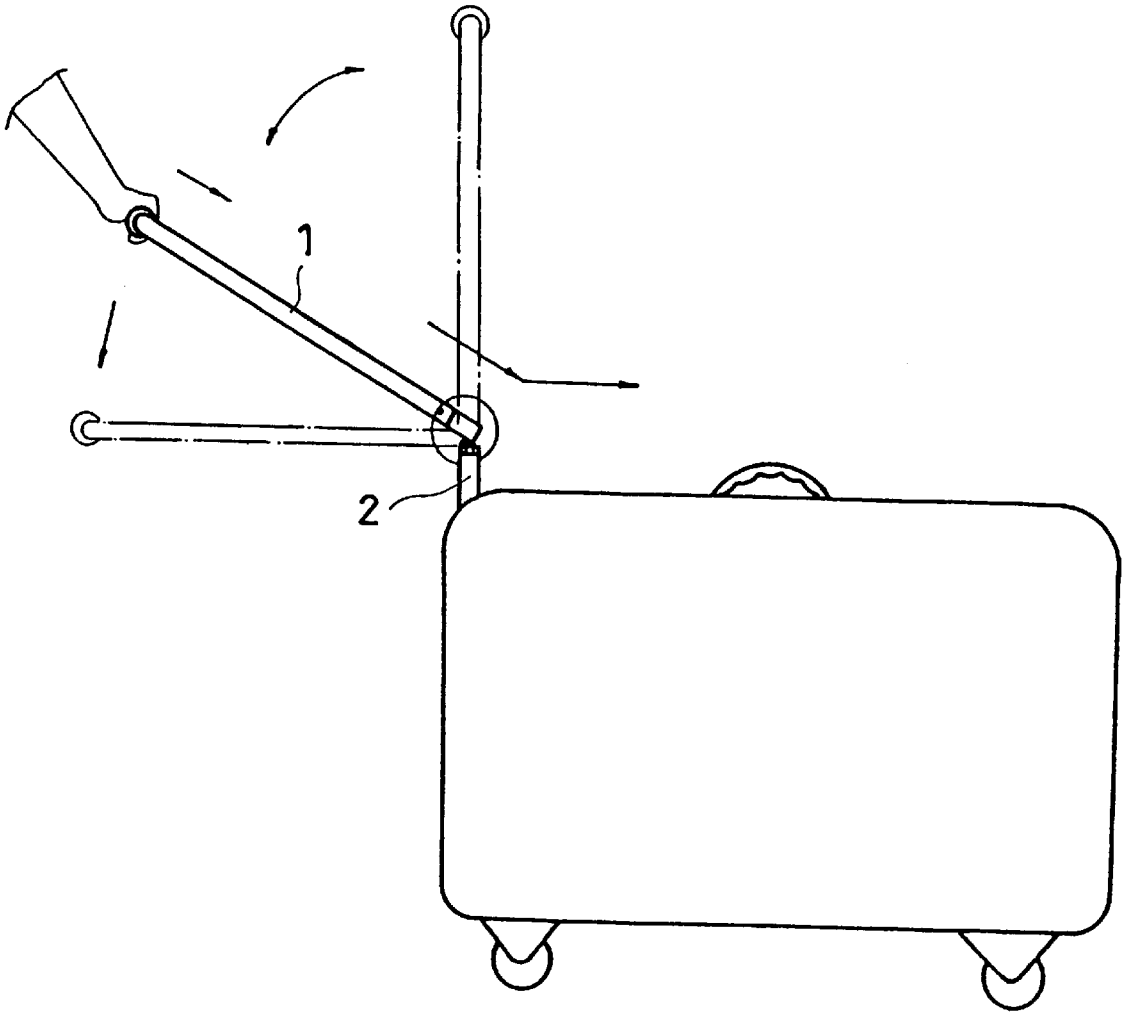
FIG.1 PRIOR ART
FIG. 1 is a schematic drawing showing a pulling handle installed in a wheeled travel bag and operated according to the prior art.
Figure 2:
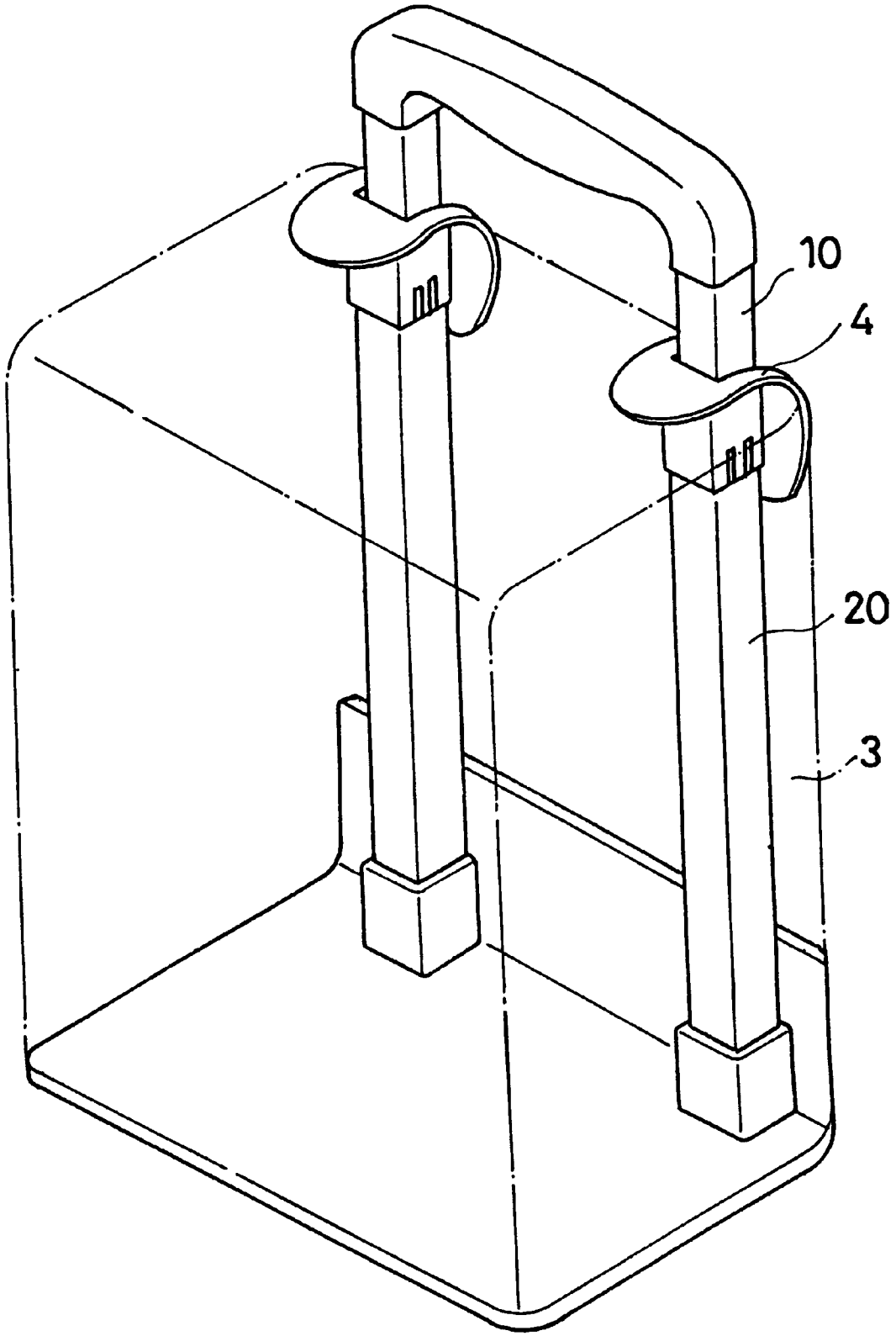
FIG. 2 shows a pulling handle installed in a travel bag according to the present invention.

Referring to FIG. 2, a carrying handle in accordance with the present invention is generally comprised of two parallel sleeves 20 fixedly mounted in a travel bag 3, two mounting blocks 4 respectively mounted on the travel bag 3 to hold the top ends of the sleeves 20, and two inner tubes 10 joined by a hand grip and moved in and out of the sleeves 20.

Figure 3:
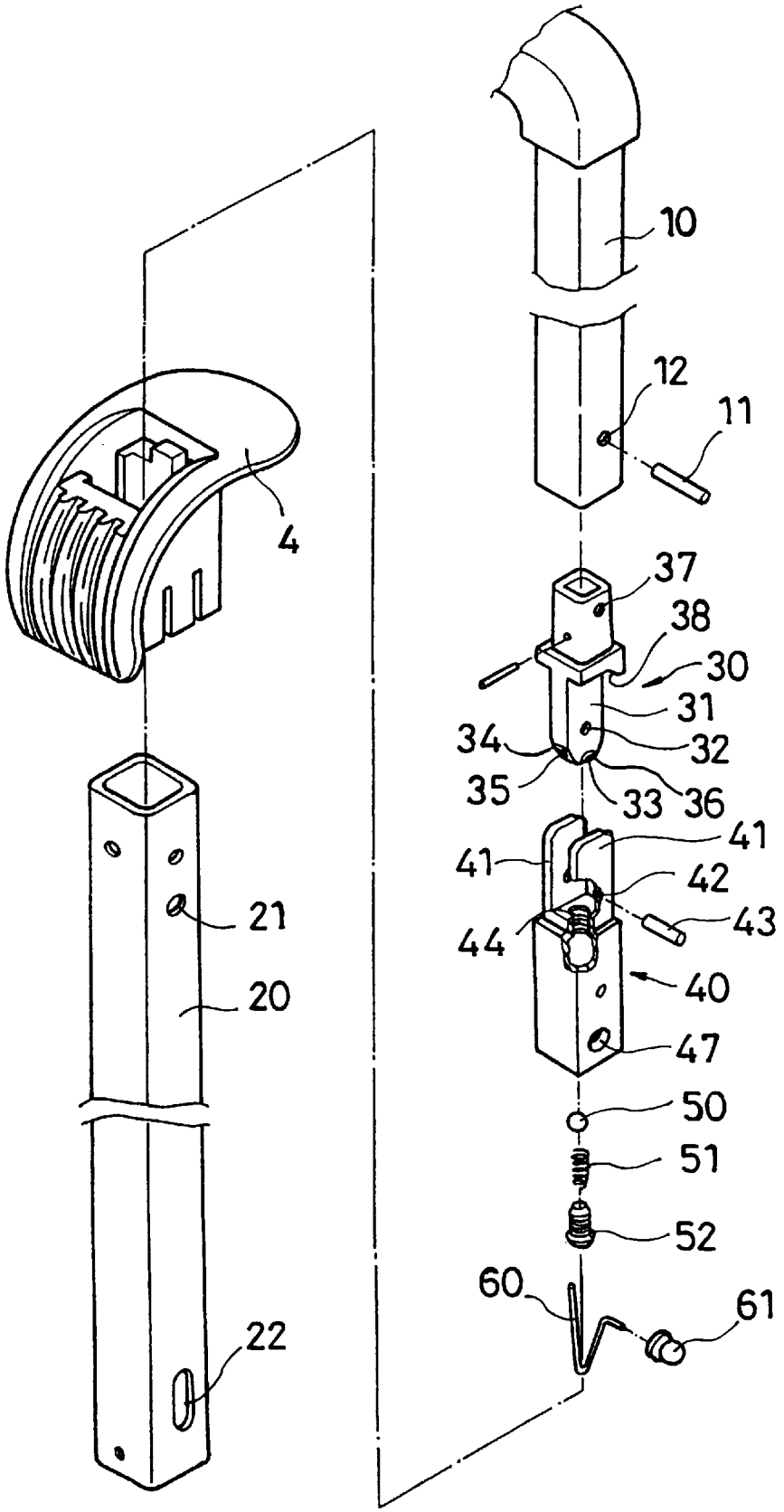
FIG. 3 is an exploded view of the pulling handle according to the present invention.

Referring to FIG. 3, the sleeve 20 comprises a first locating hole 21 and a second locating hole 22 near its top and bottom ends. The inner tube 10 is a square tube having a pin hole 12 near its bottom end. A locating block 40 is coupled to the bottom end of the inner tube 10 by a coupling block 30. The coupling block 30 comprises a square top coupling tube 37 fitted into the bottom end of the inner tube 10 and fixedly secured to the pin hole 12 by a locating pin 11, a flat bottom coupling plate 31 pivoted to the locating block 40 and a flange 38 raised around the periphery on the middle stopped outside the sleeve 20. The flat bottom coupling plate 31 comprises a transverse pivot hole 32, a flat bottom edge 33, a bevel front edge 34 extended upwardly outwards from the flat bottom edge 33, a first rounded recess 35 at the bevel front edge 34, and a second rounded recess 36 at the flat bottom edge 33. The locating block 40 is a hollow block comprising two parallel upright plates 41 raised from its top side, the upright plates 41 having a respective pivot hole 42 respectively connected to the transverse pivot hole 32 of the flat bottom coupling plate 31 of the coupling block 30 at two opposite sides by a pivot 43, a transverse through hole 47 near its hollow bottom end, and a vertical screw hole 44 at its top side between the upright plates 41. A spring member 60 is mounted inside the locating block 40. A bit 61 is fixedly mounted on one end of the spring member 60, and pushed by the spring force of the spring member 60 out of the transverse through hole 47 of the locating block 40 into engagement with the first locating hole 21 or second locating hole 22 of the sleeve 20. An adjustment screw 52 is mounted inside the locating block 40 and threaded into the vertical screw hole 44 from the bottom side. A compression spring 51 is mounted in the vertical screw hole 44 and supported on the adjustment screw 52. A steel ball 50 is supported on the compression spring 51 and forced by it into engagement with the rounded recess 35 or 36 on the flat bottom coupling plate 31 of the coupling block 30.

Figure 4A:
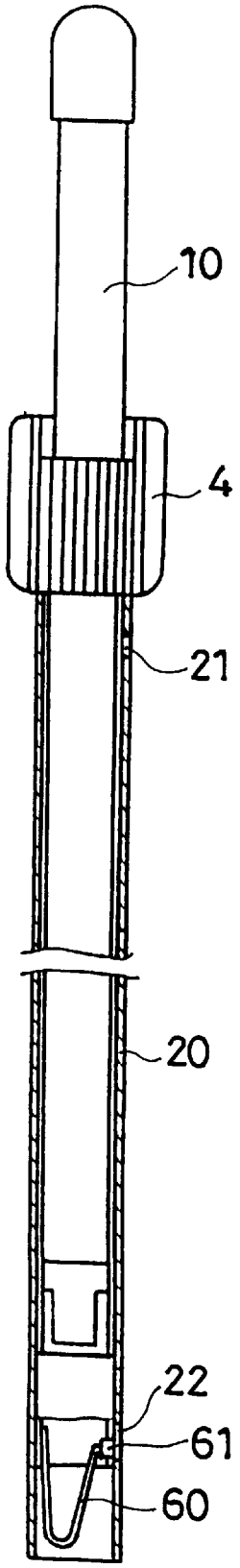
FIG. 4A is a sectional view of the present invention, showing the inner tube moved to from the collapsed position to the extended position.
Figure 4B:
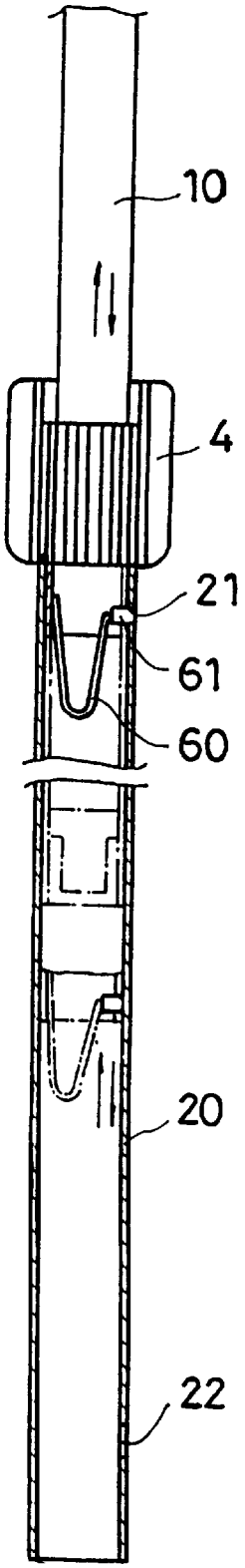
FIG. 4B is another sectional view of the present invention, showing the inner tube moved from the extended position to the collapsed position.

Referring to FIGS. 4A and 4B, when the inner tube 10 is pulled upwards from the sleeve 20, the bit 61 is forced into the inside of the transverse through hole 47 on the locating block 40, for permitting the inner tube 10 to be pulled to the extended position outside the sleeve 20. When the inner tube 10 is pulled to the extended position, the transverse through hole 47 of the locating block 40 becomes in alignment with the first locating hole 21 on the sleeve 20, and the bit 61 is immediately forced by the spring force of the spring member 60 out of the transverse through hole 47 into engagement with the first locating hole 21, and therefore the inner tube 10 is retained in the extended position (see FIG. 4B). On the contrary, when the inner tube 10 is forced downwards, the bit 61 is forced into the inside of the transverse through hole 47 on the locating block 40, for permitting the inner tube 10 to be lowered from the extended position shown in FIG. 4B to the collapsed position shown in FIG. 4A. When the inner tube 10 is lowered to the collapsed position, the transverse through hole 47 of the locating block 40 becomes in alignment with the second locating hole 22 on the sleeve 20, and the bit 61 is immediately forced by the spring force of the spring member 60 out of the transverse through hole 47 into engagement with the second locating hole 22, and therefore the inner tube 10 is retained in the extended position (see FIG. 4A).

Figure 5C:
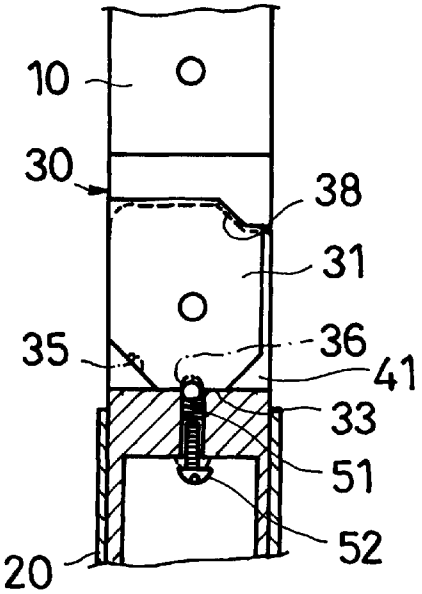
FIG. 5C is similar to FIG. 5B but showing the inner tube turned to the vertical position, the steel ball forced into engagement with the second rounded recess.
Figure 5B:
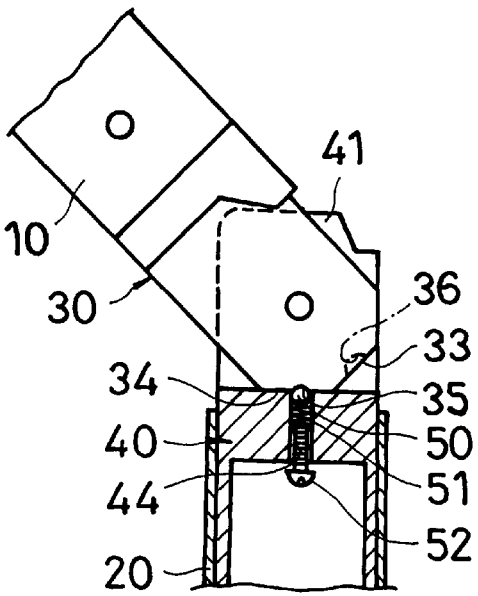
FIG. 5B is a sectional in an enlarged scale of a part of the present invention, showing the inner tube turned to the oblique position, the steel ball forced into engagement with the first rounded recess.
Figure 5A:
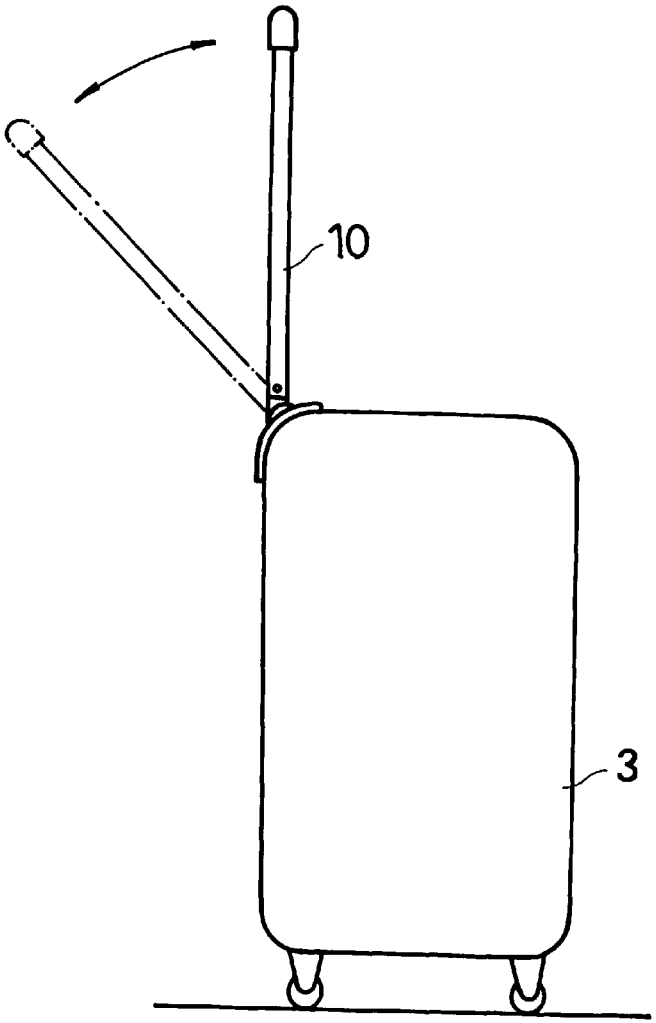
FIG. 5A is a schematic drawing showing the inner tube turned relative to the sleeve on the travel bag according to the present invention.

Referring to FIGS. 5A, 5B and 5C, when the inner tube 10 is moved to the extended position, it can be adjusted between a vertical position shown in FIG. 5C and an oblique position shown in FIG. 5B. When the inner tube 10 is moved to the extended position, the steel ball 50 is forced by the compression spring 51 into engagement with the second rounded recess 36 on the flat bottom edge 33 of the bottom coupling plate 31 of the coupling block 30, and therefore the inner tube 10 is retained in a vertical position in line with the sleeve 20 (see FIG. 5C). When the inner tube 10 is pulled downwards with force, the bottom coupling plate 31 of the coupling block 30 is turned with the inner tube 10 to force the second rounded recess 36 away from the steel ball 50, and to force the first rounded recess 35 into engagement with the steel ball 50, and therefore the inner tube 10 is retained in an oblique position relative to the sleeve 20 (see FIG. 5B). Further, by turning the adjustment screw 52 in the vertical screw hole 44, the spring power of the compression spring 51 is relatively adjusted.

While only one embodiment of the present invention has been shown and described it will be understood that various modifications and changes could be made thereunto without departing from the spirit and scope of the invention disclosed.

What the invention claimed is:

1. A travel bag pulling handle comprising two parallel sleeves fixedly mounted in a travel bag, two mounting blocks respectively mounted on said travel bag to hold top ends of said sleeves, and two inner tubes joined by a hand grip and moved in and out of said sleeves between an extended position and a collapsed position, each of said inner tubes having (a) lock means adapted to lock said inner tube between said extended position and said collapsed position, and (b) an angular position control device respectively mounted on a bottom end of said inner tube for permitting said inner tubes to be set between a vertical position and an oblique position when said inner tubes have been moved to said extended position outside said sleeves, wherein each said angular position control device includes:

a coupling block, said coupling block comprising (a) a square top coupling tube at a top side fitted into a bottom end of a respective inner tube and fixedly secured thereto by a locating pin, (b) a flat bottom coupling plate formed on a bottom side of said coupling block, and (c) a flange formed on a middle portion of said coupling block, said flat bottom coupling plate comprising a transverse pivot hole, a flat bottom edge, a bevel front edge extending upwardly and outwardly from said flat bottom edge, a first rounded recess at said bevel front edge, and a second rounded recess at said flat bottom edge;

a hollow locating block pivotally coupled to said coupling block, said hollow locating block comprising a top side, two parallel upright plates extending from said top side and bilaterally coupled to the transverse pivot hole of the bottom coupling plate of said coupling block by a pivot, and a vertically directed screw hole formed in said top side between said upright plates;

an adjustment screw mounted inside said hollow locating block and threaded into said vertically directed screw hole from a bottom side of said hollow locating block;

a compression spring mounted in said vertically directed screw hole of said hollow locating block and supported on said adjustment screw; and, a steel ball supported on said compression spring and biased thereby into engagement with the first rounded recess on the bevel front edge of said coupling block when said inner tube is turned to said oblique position, or the second rounded recess on the flat bottom edge of said coupling block when said inner tube is turned to said vertical position.

* * * * *